US009744759B2

(12) United States Patent
Inoue

(10) Patent No.: US 9,744,759 B2
(45) Date of Patent: Aug. 29, 2017

(54) POSITION CORRECTION APPARATUS, LIQUID EJECTION APPARATUS, AND METHOD FOR CORRECTING POSITION

(71) Applicant: Takahiro Inoue, Kanagawa (JP)

(72) Inventor: Takahiro Inoue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/294,904

(22) Filed: Oct. 17, 2016

(65) Prior Publication Data

US 2017/0106647 A1 Apr. 20, 2017

(30) Foreign Application Priority Data

Oct. 20, 2015 (JP) ..... 2015-206329
Aug. 29, 2016 (JP) ..... 2016-166522

(51) Int. Cl.
*B41J 2/045* (2006.01)
*B41J 13/00* (2006.01)

(52) U.S. Cl.
CPC ..... *B41J 2/04505* (2013.01); *B41J 2/04586* (2013.01); *B41J 2/04503* (2013.01); *B41J 13/009* (2013.01)

(58) Field of Classification Search
CPC B41J 2/04586; B41J 2/04503; B41J 2/04573; B41J 11/008; B41J 11/42; B41J 13/0009; B41J 2/04508; B41J 19/202
See application file for complete search history.

(56) References Cited

U.S. PATENT DOCUMENTS 8,172,357 B2 5/2012 Enomoto
8,831,774 B2 9/2014 Inoue
9,028,027 B2 5/2015 Bell et al.
2011/0074854 A1* 3/2011 Saettel ..... B41J 2/04503 347/16
2016/0121602 A1 5/2016 Nagasu et al.

FOREIGN PATENT DOCUMENTS

JP 2010-137489 6/2010
JP 2015-013476 1/2015

* cited by examiner

*Primary Examiner* — Thinh H Nguyen
(74) *Attorney, Agent, or Firm* — IPUSA, PLLC

(57) ABSTRACT

A position correction apparatus that corrects a position of a liquid ejection unit ejecting liquid toward a conveyed object includes a position detection unit configured to detect a position of the conveyed object in a width direction of the conveyed object, a moving unit configured to move the liquid ejection unit in the width direction, a moving amount determination unit configured to determine a moving amount of the liquid ejection unit in the width direction based on a position of the conveyed object in the width direction, a moving speed determination unit configured to determine a moving speed of the liquid ejection unit in accordance with a conveyance speed of the conveyed object, and a move control unit configured to control the moving unit so as to move the liquid ejection unit at the moving speed and by the moving amount in the width direction.

9 Claims, 15 Drawing Sheets

POSITION CORRECTION APPARATUS, LIQUID EJECTION APPARATUS, AND METHOD FOR CORRECTING POSITION

BACKGROUND OF THE INVENTION

1. Field of the Invention

The present disclosure relates to position correction apparatuses, liquid ejection apparatuses, and methods for correcting position.

2. Description of the Related Art

For example, an inkjet recording apparatus is known, which forms an image by ejecting ink on a long print sheet from a plurality of nozzles provided in a liquid ejection unit.

In such an inkjet recording apparatus, ink ejection position may shift and in a case where a color image is formed by using a plurality of liquid ejection units, color overlapping accuracy may degraded due to meandering, wrinkle, etc. of the print sheet.

Therefore, a technology is disclosed, in which the liquid ejection units are moved based on conveyance information obtained from print sheet edge position detection results of a plurality of edge sensors, thereby forming the image without unevenness (e.g. Japanese Unexamined Patent Application Publication No. 2010-137489).

According to the technology disclosed in Japanese Unexamined Patent Application Publication No. 2010-137489, the liquid ejection unit is moved so that a relative position of the liquid ejection unit with respect to the print sheet becomes constant by calculating moving speed of the liquid ejection unit based on print sheet shifting speed, thereby forming the image in which unevenness is reduced.

In the liquid ejection unit, image resolution can be improved by forming a plurality of nozzle array in which a plurality of nozzles are arranged in a width direction of print sheet to increase density of nozzles in the width direction. In such a liquid ejection unit, nozzles disposed adjacent to each other in the width direction of the print sheet are separated each other in a conveyance direction of the print sheet. Therefore, in a case where the liquid ejection unit is moved in the width direction according to print sheet edge position during the image forming, dot interval in the width direction of the print sheet may change.

RELATED ART DOCUMENT

Patent Document

[Patent Document 1]: Japanese Unexamined Patent Application Publication No. 2010-137489

SUMMARY OF THE INVENTION

An object of the present disclosure is to provide a position correction apparatus capable of correcting the position of the liquid ejection unit according to conveyance position of a conveyed object and capable of reducing dot interval unevenness.

The following configuration is adopted to achieve the aforementioned object.

In one aspect of the embodiment of the present disclosure, there is provided a position correction apparatus that corrects a position of a liquid ejection unit ejecting liquid toward a conveyed object. The position correction apparatus includes a position detection unit configured to detect a position of the conveyed object in a width direction of the conveyed object, a moving unit configured to move the liquid ejection unit in the width direction, a moving amount determination unit configured to determine a moving amount of the liquid ejection unit in the width direction based on a position of the conveyed object in the width direction, a moving speed determination unit configured to determine a moving speed of the liquid ejection unit in accordance with a conveyance speed of the conveyed object, and a move control unit configured to control the moving unit so as to move the liquid ejection unit at the moving speed and by the moving amount in the width direction.

Other objects, features, and advantages of the present disclosure will become apparent from the following detailed description when read in conjunction with the accompanying drawings.

DETAILED DESCRIPTION OF THE PREFERRED EMBODIMENTS

Figure 1:
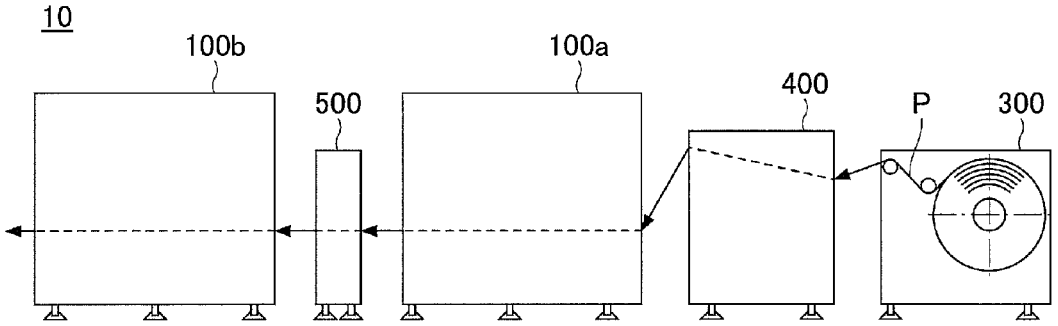
FIG. 1 is a diagram illustrating an example liquid ejection system of an embodiment of the present disclosure.

In the following, embodiments of present disclosure will be described with reference to accompanying drawings. In the present specification and drawings, identical reference numerals will be applied to elements or the like that have substantially similar functions and configurations to those in another drawing, and descriptions thereof may be omitted.

<Liquid Ejection System>

FIG. 1 is a diagram illustrating an example liquid ejection system 10 of an embodiment of the present disclosure.

As illustrated in FIG. 1, the liquid ejection system 10 includes a first liquid ejection apparatus 100*a*, a second liquid ejection apparatus 100*b*, a sheet feeding apparatus 300, a pretreatment liquid coating unit 400, and a sheet reversal device 500. The first liquid ejection apparatus 100*a* and the second liquid ejection apparatus 100*b* of the present embodiment have similar configurations for driving a liquid ejection head to eject liquid droplets. The liquid ejection apparatus includes not only apparatuses that can eject liquid droplets to an object to which the liquid can be adhered but also apparatuses that eject the liquid droplets to the air or that eject the liquid droplets in a fluid. In the following, the first liquid ejection apparatus 100*a* and the second liquid ejection apparatus 100*b* may be referred to be simply liquid ejection apparatus 100.

A print sheet is fed from the sheet feeding apparatus 300 to the first liquid ejection apparatus 100*a*, and the first liquid ejection apparatus 100*a* ejects ink droplets on a first surface of the print sheet P to form an image, where the pretreatment liquid has been applied onto the first surface of the print sheet P by the pretreatment liquid coating unit 400. The print sheet P, as a recording medium, is a long continuous paper sheet that is rolled up to be stored in the sheet feeding apparatus 300, and supplied through feeding roller, etc., from the sheet feeding apparatus 300 to the pretreatment liquid coating unit 400.

The second liquid ejection apparatus 100*b* form an image on a second surface of the print sheet P by ejecting ink droplets, where the image has been formed by the first liquid ejection apparatus 100*a* on the first surface of the print sheet P and front/back surface of the print sheet P has been reversed by the sheet reversal device 500.

The liquid ejection system 10 has the configuration described above, and the images are formed on both surfaces of the long print sheet P by the first liquid ejection apparatus 100*a* and the second liquid ejection apparatus 100*b*. Additionally, a sheet cutting device for cutting the print sheet P ejected from the second liquid ejection apparatus 100*b* and a after treatment apparatus for performing after treatment on the cut print sheet P may be included in the liquid ejection system 10.

The first liquid ejection apparatus 100*a* and the second liquid ejection apparatus 100*b* of the present embodiment eject ink droplets. However, this is not a limiting example. The liquid ejected by the first liquid ejection apparatus 100*a* and the second liquid ejection apparatus 100*b* may be arbitrary liquid that has a viscosity and a surface tension appropriate for being ejected from the head. Specifically, water, solvent such as an organic solvent, suspension liquid, or emulsion including colorant such as a dye and a pigment, function providing material such as a polymerizable compound, a resin, and a surfactant, biocompatible material such as DNA, amino acid, protein, and calcium, edible material such as natural colorant, etc., may be used to be ejected. The liquid ejected from the first liquid ejection apparatus 100*a* and the second liquid ejection apparatus 100*b* is used as ink of inkjet printing, surface treatment liquid, resist pattern forming liquid applied for elements included in an electronic element, light emitting element, or electronic circuit, liquid for three-dimensional shaping material, and the like.

Additionally, the object conveyed in the first liquid ejection apparatus 100*a* and the second liquid ejection apparatus 100*b* may be an arbitrarily chosen as long as the liquid, at least temporarily, adheres to the object, where the liquid may adhere and fixed or adhere and permeated. Specifically, objects to which the liquid adheres such as a recording medium including a paper sheet, a recording sheet, and a film, a cloth, an electronic assembly including an electronic substrate and a piezoelectric element, a particle layer, a medium including an organ model, a test cell are exemplified as non-limiting examples of the conveyed object.

<Liquid Ejection Apparatus>

Figure 2:
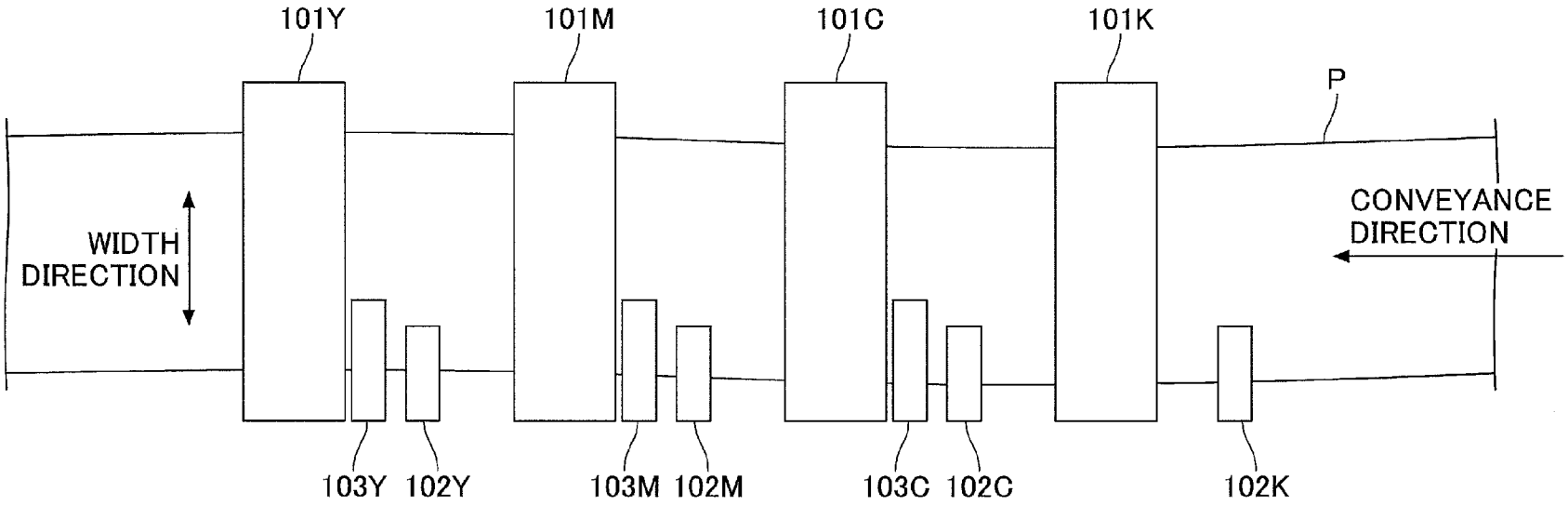
FIG. 2 is a diagram illustrating an example configuration of a liquid ejection apparatus.

FIG. 2 is a diagram illustrating an example configuration of the liquid ejection apparatus 100 of the present embodiment.

As illustrated in FIG. 2, in the liquid ejection apparatus 100, from upstream side in the conveyance direction of the print sheet P, a liquid ejection unit 101K, a liquid ejection unit 101C, a liquid ejection unit 101M, and a liquid ejection unit 101Y are provided along a conveyance path of the print sheet P in that order. Respective characters of "K", "C", "M", and "Y" indicate black, cyan, magenta, and yellow, and respective liquid ejection units 101 ejects ink droplets of respective colors to form full-color image on the print sheet P. Additionally, in the following, above described characters may be omitted.

The respective liquid ejection units 101 include a plurality of liquid ejection heads having nozzle array formed by nozzles arranged in a width direction of the print sheet P, where the width direction is orthogonal to the conveyance direction of the print sheet P. Therefore, the image of full width of the print sheet P can be formed by so called 1 path operation. Also, for example, functional components and mechanism are integrated in the liquid ejection head to form the liquid ejection unit 101. The liquid ejection unit 101 includes at least one of a head tank, a carriage, a supply mechanism, a maintenance recovery mechanism, and a scanning position moving mechanism, and the liquid ejection head.

In the respective liquid ejection units 101, an edge sensor 102 for detecting an edge position of the print sheet P is provided at upstream side in the conveyance direction. For example, the edge sensor 102 is a contact image sensor (CIS), disposed at a position corresponding to a position on which the width direction edge position of the print sheet P passes, where the width direction is orthogonal to the conveyance direction of the print sheet P. The width direction edge position of the print sheet P is detected based on an output of the edge sensor 102, where the detected position is the width direction edge position of the print sheet P that has not passes through a liquid ejection position of the liquid ejection unit 101 yet.

Also, liquid ejection units 101C, 101M, and 101Y respectively disposed in downstream side of the liquid ejection unit 101K can be moved in the width direction orthogonal to the conveyance direction of the print sheet P by corresponding actuators 103C, 103M, and 103Y. For example, the actuators 103 include servomotors, and rotation of the servomotor is converted into linear motion by a ball screw mechanism to move the liquid ejection unit 101 in the width direction.

The respective actuators 103 are driven based on detection result of the edge position of the print sheet P output from the edge sensors 102, and the liquid ejection unit 101C, the liquid ejection unit 101M, and the liquid ejection unit 101Y are moved in the width direction so as to match with an liquid ejection position of the liquid ejection unit 101K.

Additionally, the liquid ejection unit 101K may be also moved in the width direction. In this case, an actuator 103K is provided corresponding to the liquid ejection unit 101K, and the actuator 103K is driven according to the edge position in the width direction of the print sheet P detected by the edge sensor 102K.

Figure 3:
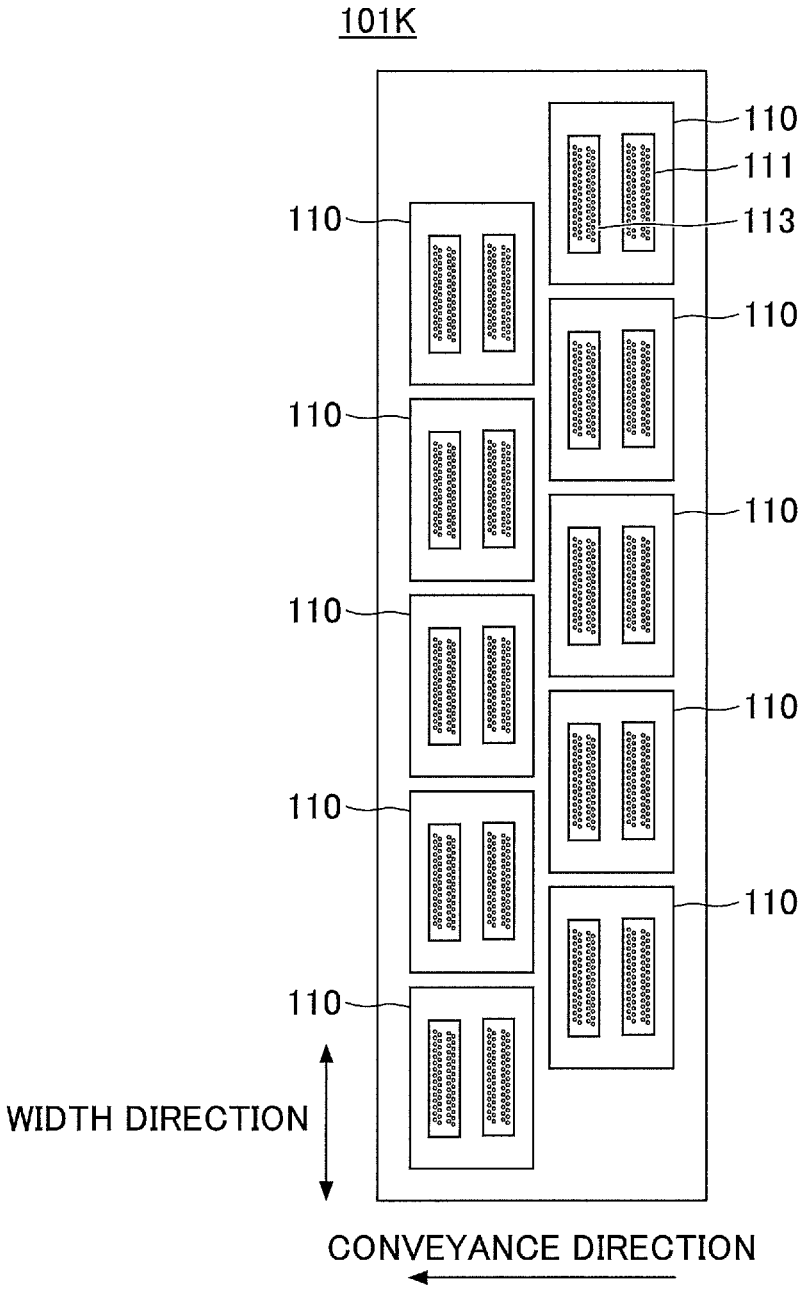
FIG. 3 is a diagram illustrating an example liquid ejection unit.
Figure 4:
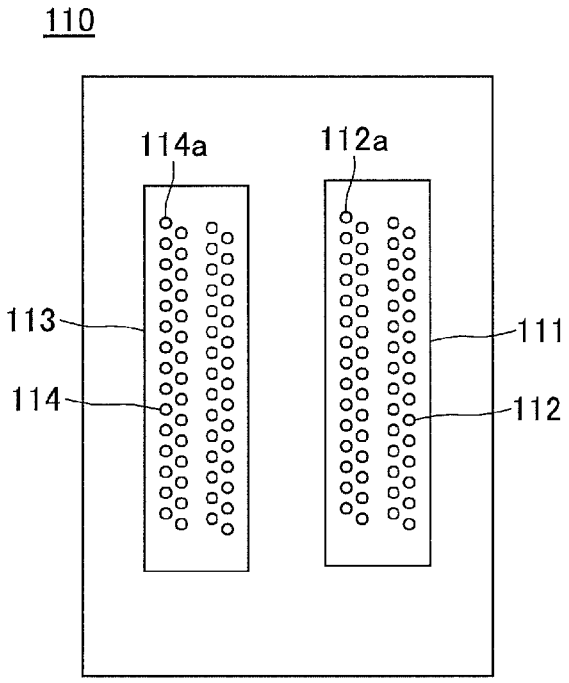
FIG. 4 is a diagram illustrating an example liquid ejection head.

FIG. 3 is a diagram illustrating an example liquid ejection unit 101 of the present embodiment. Also, FIG. 4 is a diagram illustrating an example liquid ejection head 110 disposed in the liquid ejection unit 101.

As illustrated in FIG. 3, in the liquid ejection unit 101, a plurality of liquid ejection heads 110 are arranged in a staggered manner. As illustrated in FIG. 4, the liquid ejection heads 110 respectively includes a first liquid ejection head 111, and a second liquid ejection head 113.

The first liquid ejection head 111, as a liquid ejection unit, include a plurality of nozzles 112 for ejecting ink droplets onto the surface of the print sheet P to form dots that are elements of liquid ejection. In the first liquid ejection head 111, four nozzle arrays are arranged in the conveyance direction, where a plurality of nozzles 112 are arranged in the width direction in the respective nozzle arrays.

Also, the second liquid ejection head 113, as an liquid ejection unit, include a plurality of nozzles 114 for ejecting ink droplets onto the surface of the print sheet P to form dots that are elements of liquid ejection (liquid ejection elements). Similarly to the first liquid ejection head 111, in the second liquid ejection head 113, four nozzle arrays are arranged in the conveyance direction, where a plurality of nozzles are arranged in the width direction in the respective nozzle arrays.

Figure 5:
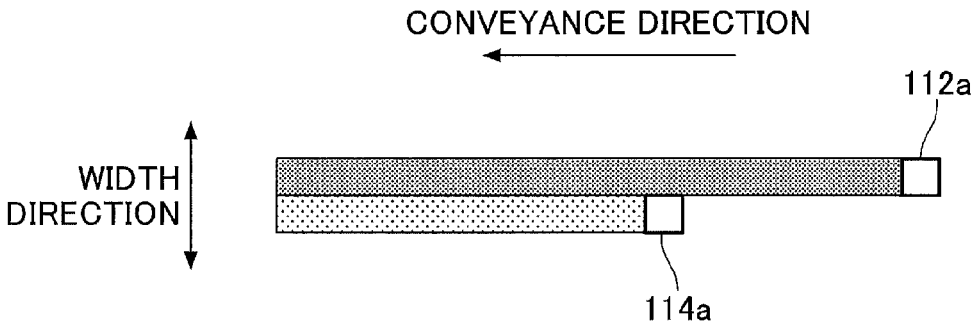
FIG. 5 is a diagram illustrating example liquid ejection areas.

The plurality of nozzles 112 and 114 respectively included in the first liquid ejection head 111 and second liquid ejection head 113 are formed such that center positions of the nozzles 112 and 114 are slightly shifted each other in the with direction. FIG. 5 is a diagram illustrating example liquid ejection areas of nozzle 112*a* and nozzle 114*a*, where the nozzle 112*a* is formed at the upmost portion of the first liquid ejection head 111 and the nozzle 114*a* is formed at the upmost portion of the second liquid ejection head 113 in FIG. 4.

As illustrated in FIG. 5, in the width direction, the nozzle 112*a* of the first liquid ejection head 111 forms an image by ejecting ink droplet at a position on the surface of the print sheet P adjacent to a position at which the nozzle 114*a* of the second liquid ejection head 113 forms an image by ejecting ink droplet. In FIG. 5, a liquid ejection area in which the nozzle 112*a* ejects ink droplets is illustrated with a hatching pattern that is different from a hatching pattern for illustrating a liquid ejection area in which the nozzle 114*a* ejects ink droplets. Additionally, the liquid ejection area of the nozzle 112 included in the first liquid ejection head 111 and the liquid ejection area of the nozzle 114 included in the second liquid ejection head 113 may be partly overlapped in the width direction on the surface of the print sheet P.

As described above, the nozzles 112 included in the first liquid ejection head 111 and the nozzles 114 included in the second liquid ejection head 113 are formed such that respective center positions thereof are slightly shifted in the width direction. In other words, nozzles are arranged in the first liquid ejection head 111 and the second liquid ejection head 113 such that nozzles for forming dots as the liquid ejection elements at positions adjacent to each other in the width direction of the print sheet P are spaced each other in the conveyance direction.

The liquid ejection unit 101 can form the image in the width direction of the print sheet P without a clearance, where the liquid ejection head 110 for forming the image in a predetermined area in the width direction are arranged in the staggered manner as described above. According to the above described configuration, the liquid ejection unit 101 of the present embodiment can form a high resolution image on the print sheet P because nozzle density in the width direction is increased.

Additionally, number and positions of the liquid ejection head 110 included in the liquid ejection unit 101 and number and positions of nozzles included in the liquid ejection head 110 described in the present embodiment are not limiting examples.

<Hardware Configuration>

Figure 6:
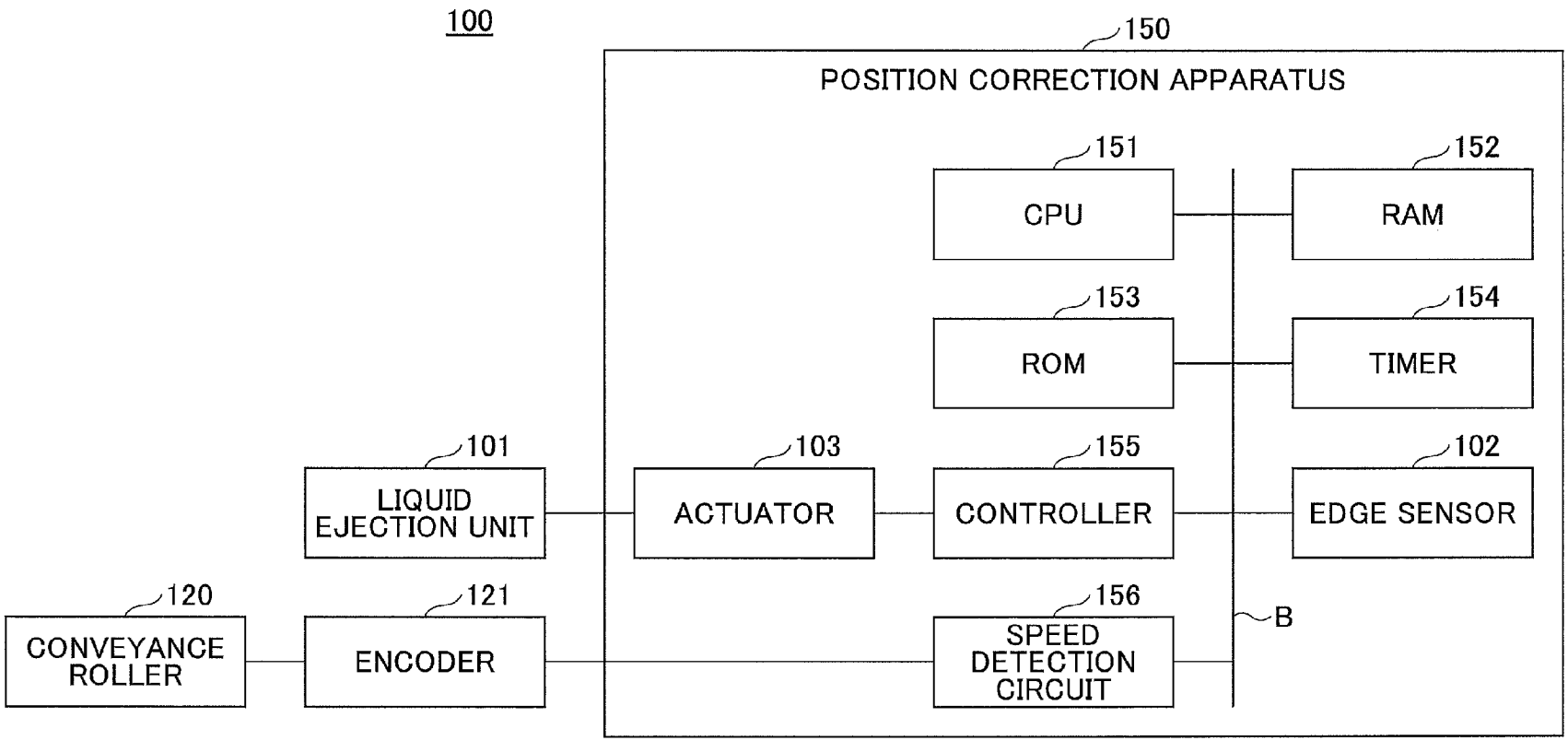
FIG. 6 is a diagram illustrating an example hardware configuration of the liquid ejection apparatus.

FIG. 6 is a diagram illustrating an example hardware configuration of the liquid ejection apparatus 100 of the present embodiment.

As illustrated in FIG. 6, the liquid ejection apparatus 100 includes a liquid ejection unit 101, a conveyance roller 120, an encoder 121, and a position correction apparatus 150.

The liquid ejection unit 101 has a configuration described above, and ejects droplets onto the surface of the print sheet P based on image data input into the liquid ejection apparatus 100, thereby forming the image. The liquid ejection apparatus 100 includes liquid ejection units 101 for forming images with respective colors of Y, M, C, and K, and forms the full color image by overlapping respective color images on the surface of the print sheet P.

For example, the conveyance roller 120 is formed as a pair of rollers for nipping the print sheet P therebetween to convey the print sheet, where one of the rollers rotates and the other is driven according to the rotation of the one of the rollers. The conveyance roller 120 can convey the print sheet P at variable conveyance speed, where e.g., three conveyance speeds of "low", "middle", and "high" can be set.

For example, the encoder 121 is disposed at a rotation axis of the driven roller included in the conveyance roller 120, and the encoder 121 outputs a conveyance signal (6 ppi signal) upon the print sheet P being conveyed, by the conveyance roller 120, every one sixth inch that is a detection distance.

The conveyance roller 120 and the encoder 121 are examples of transfer unit for conveying the print sheet P in the liquid ejection apparatus 100. Additionally, another configuration of the conveyance unit may be applied as long as the conveyance signal can be output each time the print sheet P is to be conveyed the predetermined distance.

The position correction apparatus 150 includes an edge sensor 102, an actuator 103, a CPU 151, a RAM 152, a ROM 153, and a timer 154, a controller 155, and a speed detection circuit 156, where the respective elements are connected via a bus B.

As described above, the edge sensors 102 are disposed at upstream side of the respective liquid ejection units 101C, 101M, and 101Y in the conveyance direction of the print sheet P. The actuators 103 are coupled to the respective liquid ejection units 101C, 101M, and 101Y, and move the liquid ejection units 101 in the width direction under control of the controller 155.

Programs and data used by the programs are stored in the ROM 153. The RAM 152 is used as a storage area for loading the program, a work area for the loaded program, and the like. The CPU 151 executes the programs loaded into the RAM 152 to achieve respective functions.

For example, the timer 154 is used for detecting the conveyance speed of the print sheet P in the liquid ejection apparatus 100, and the like.

The controller 155 controls the actuator 103 so as to move the liquid ejection unit 101 in the width direction based on a position correction amount that is calculated from the edge position in the width direction of the print sheet P detected based on the output from the edge sensor 102. Also, the controller 155 controls the actuator 103 so as to move the liquid ejection unit 101 at a moving speed that is set based on the conveyance speed of the print sheet P detected based on the output from the encoder 121.

The speed detection circuit 156 detects the conveyance speed of the print sheet P conveyed by the conveyance roller 120 based on the conveyance signal output from the encoder 121.

<Functional Configuration>

Figure 7:
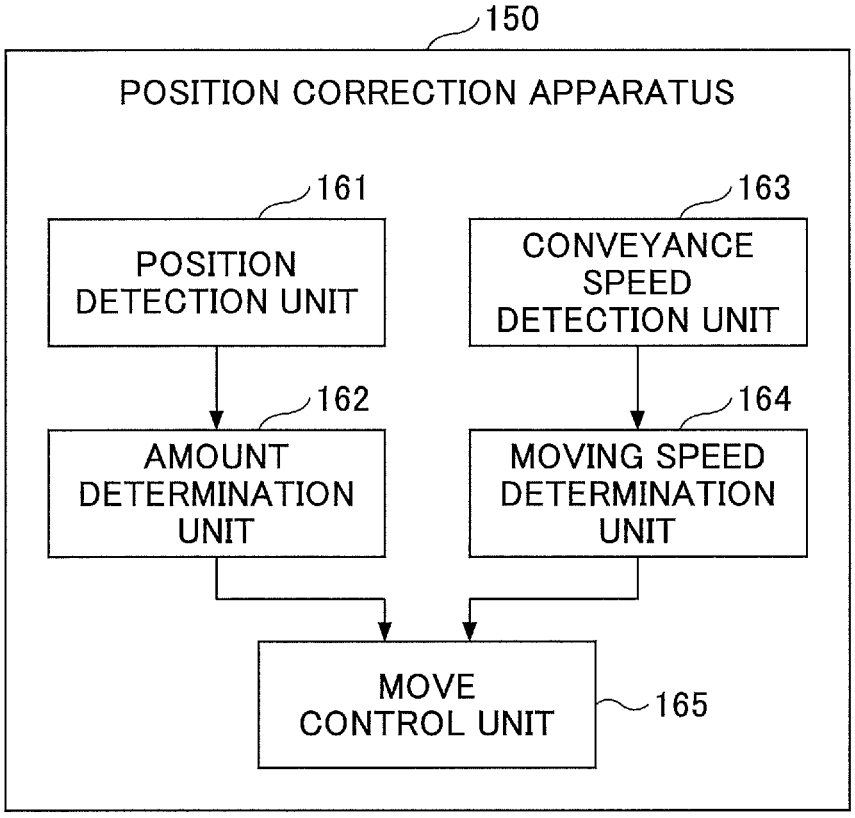
FIG. 7 is a diagram illustrating an example functional configuration of a position correction apparatus.

FIG. 7 is a diagram illustrating a functional configuration of the position correction apparatus 150 of the present embodiment.

As illustrated in FIG. 7, the position correction apparatus 150 includes a position detection unit 161, a move amount determination unit 162, a conveyance speed detection unit 163, a moving speed determination unit 164, and a move control unit 165.

The position detection unit 161 detects the edge position in the width direction of the print sheet P based on the output from the edge sensor 102. The move amount determination unit 162 determines a position moving amount of the liquid ejection unit 101 in the width direction based on the edge position in the width direction of the print sheet P detected by the position detection unit 161.

The conveyance speed detection unit 163 acquires the conveyance speed of the print sheet P conveyed by the conveyance roller 120, where the conveyance speed is detected by the speed detection circuit 156. Also, the conveyance speed detection unit 163 may acquire the conveyance signal output form the encoder 121 to detect the conveyance speed of the print sheet P by measuring intervals of the conveyance signal using the timer 154.

The moving speed determination unit 164 determines the moving speed of the liquid ejection unit 101 based on the conveyance speed of the print sheet P detected by the conveyance speed detection unit 163.

The move control unit 165 sets the conveyance speed calculated by the moving speed determination unit 164 and the position correction amount calculated by the move amount determination unit 162 in the controller 155. The actuator 103 is driven under control of the controller 155, and the respective liquid ejection units 101 are moved by the set position correction amount in the width direction at the set moving speed.

<Position Correction of Liquid Ejection Unit>

Figure 8:
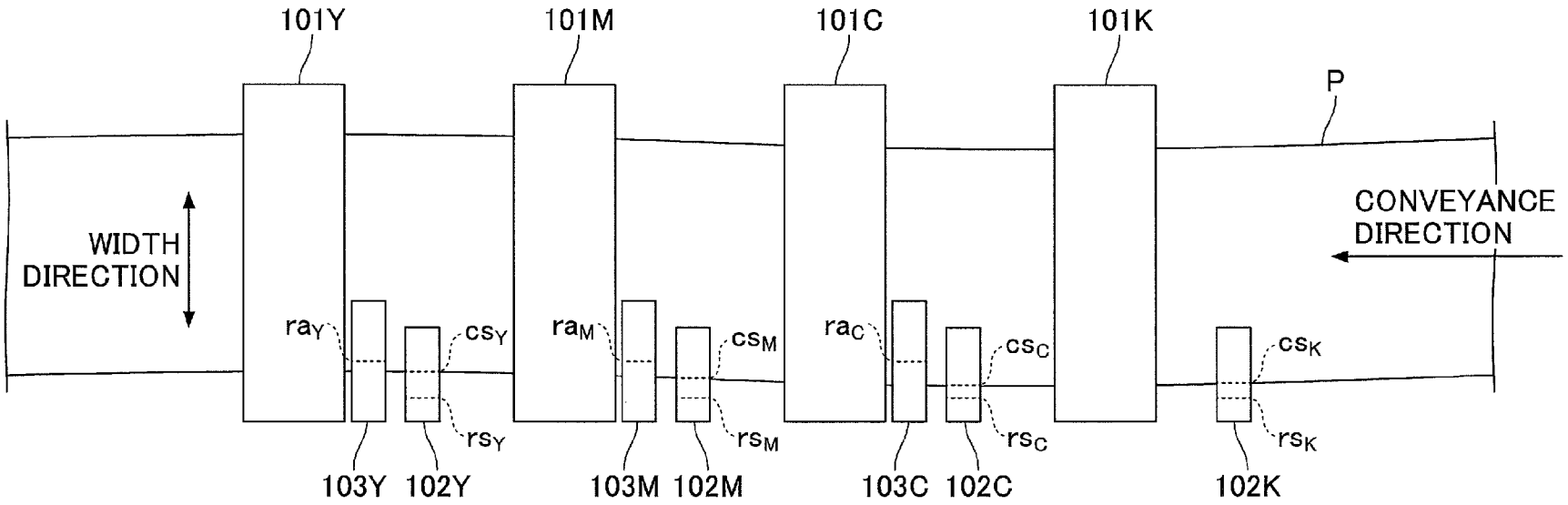
FIG. 8 is a diagram illustrating position correction of the liquid ejection unit.

In the following, a method for calculating the position correction amount of the liquid ejection unit 101 in the width direction performed by the move amount determination unit 162 will be described with reference to FIG. 8.

In a case where an image is formed on the print sheet P by the liquid ejection apparatus 100, first, the position detection unit 161 acquires an output value of the edge sensor 102K to detect the edge position $CS_K$ in the width direction of the print sheet P corresponding to a detection position of the edge sensor 102K. Also, the move amount determination unit 162 calculates a position sift amount $d_K$ ($=CS_K-RS_K$) based on a difference (distance) between the edge position $CS_K$ corresponding to a detection position of the edge sensor 102K and a reference position $RS_K$.

Then, the position detection unit 161 acquires the output value of the edge sensor 102C to detect the edge position $CS_C$ in the width direction of the print sheet P corresponding to a detection position of the edge sensor 102C. Also, the move amount determination unit 162 calculates a position sift amount $d_C$ ($=CS_C-RS_C$) based on a difference (distance) between the edge position $CS_c$ corresponding to a detection position of the edge sensor 102C and a reference position $RS_C$.

The move amount determination unit 162 calculates a difference between the position sift amount $d_K$ and the position sift amount $d_C$, thereby calculating a relative position shift amount $D_C(=d_C-d_K)$ between the liquid ejection unit 101K and the liquid ejection unit 101C. The move amount determination unit 162 sets the calculated position sift amount $D_C$ to be the position moving amount of the liquid ejection unit 101C in the width direction.

The move control unit 165 can match the liquid ejection position of the liquid ejection unit 101C with the liquid ejection position of the liquid ejection unit 101K by moving the liquid ejection unit 101C by the relative position shift amount $D_C$ with respect to a reference position $ra_C$.

The reference position "ra" corresponds to a control position of the actuator 103 at which the liquid ejection positions in the width direction of the respective liquid ejection units 101 match each other, provided the edge position "rs" of the print sheet P is detected by respective edge sensors 102.

Similarly, the move amount determination unit 162 calculates a relative position shift amount $D_M$ between the liquid ejection unit 101K and the liquid ejection unit 101M and a relative position shift amount $D_Y$ between the liquid ejection unit 101K and the liquid ejection unit 101Y. The move amount determination unit 162 sets the calculated position sift amount $D_C$ and $D_Y$ to be the position moving amounts of the liquid ejection units 101M and 101Y in the width direction. The move control unit 165 matches the liquid ejection positions of the liquid ejection units 101M and 101Y with the liquid ejection position of the liquid ejection unit 101K in the width direction by moving the liquid ejection units 101M and 101Y by the calculated position moving amounts.

As described above, the move amount determination unit 162 determines the position moving amount with reference to the edge position of the print sheet P in the width direction corresponding to a detection position of the edge sensor 102K, and the move control unit 165 moves the respective liquid ejection units 101 in the width direction.

In the present embodiment, the liquid ejection units 101C, 101M, and 101Y are moved with reference to the edge position of the print sheet P in the width direction corresponding to the detection position of the edge sensor 102K so that the liquid ejection positions of the liquid ejection units 101C, 101M, and 101Y match with that of the liquid ejection unit 101K. In this way, the position shift of the respective color images formed on the print sheet P can be prevented by moving the respective liquid ejection units 101 so as to match the liquid ejection positions in the width direction.

Additionally, for example, the position of one liquid ejection unit 101 may be moved in the width direction so as to match with the position of another liquid ejection unit 101 disposed at upstream side and adjacent to the one liquid ejection unit 101 as long as the respective liquid ejection positions on the print sheet P can be matched.

For example, the position of the liquid ejection unit 101M may be moved so as to match with the position of the liquid ejection unit 101C in the width direction, where the position correction amount is defined by calculating the relative position shift amount D between the liquid ejection unit 101C and the liquid ejection unit 101M based on the output from the edge sensor 102C and the edge sensor 102M. In this case, the position of the liquid ejection unit 101Y is moved so as to match with the position of the liquid ejection unit 101M in the width direction, where the position correction amount is defined by calculating the relative position shift amount D between the liquid ejection unit 101M and the liquid ejection unit 101Y based on the output from the edge sensor 102M and the edge sensor 102Y.

<Moving Speed of Liquid Ejection Unit>

In the following, the moving speed of the liquid ejection unit 101 will be described.

Figure 9:
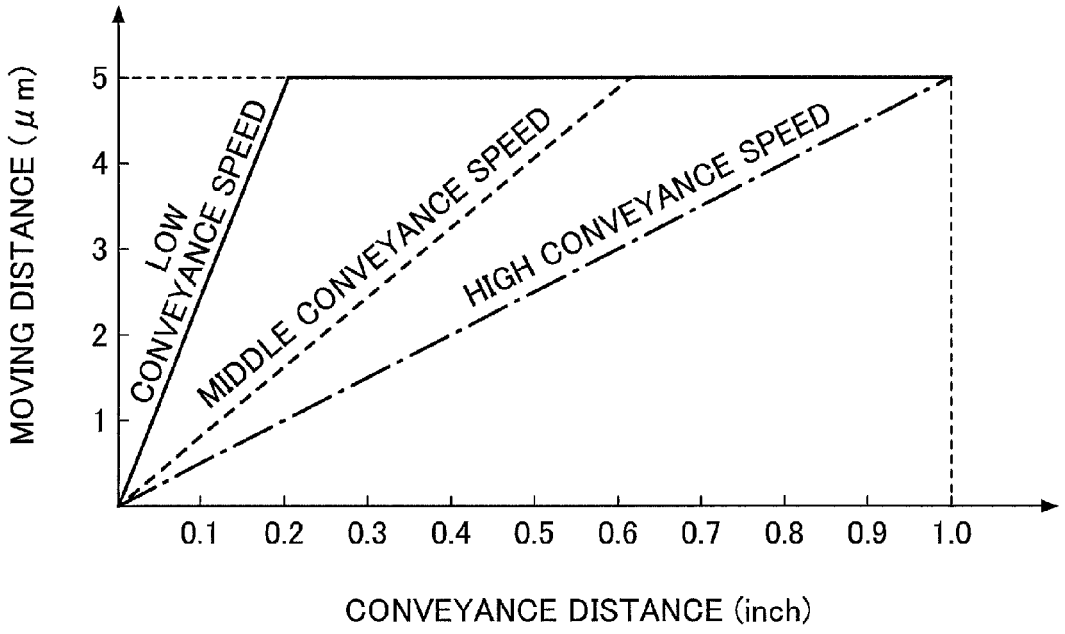
FIG. 9 is a graph illustrating an example of relationship between a print sheet conveyance distance and a moving distance of the liquid ejection unit in a case where the moving speed of the liquid ejection unit is constant.

FIG. 9 is a graph illustrating an example of relationship between a print sheet conveyance distance and a moving distance of the liquid ejection unit 101 in a case where the moving speed of the liquid ejection unit 101 is constant.

As illustrated in FIG. 9, the relationship between a print sheet conveyance distance and a moving distance of the liquid ejection unit 101 is changed in accordance with the conveyance speed of the print sheet P in a case where the moving speed of the liquid ejection unit 101 in the width direction is constant. For example, when the print sheet P is conveyed at high conveyance speed, the print sheet P is conveyed by 1 inch while the liquid ejection unit 101 moves a predetermined distance (5 μm). On the other hand, when the print sheet P is conveyed at middle conveyance speed or low conveyance speed, the print sheet P is conveyed by 0.6 inch or 0.2 inch while the liquid ejection unit 101 moves a predetermined distance. Thus, the conveyance distance becomes shorter.

Figure 10A:
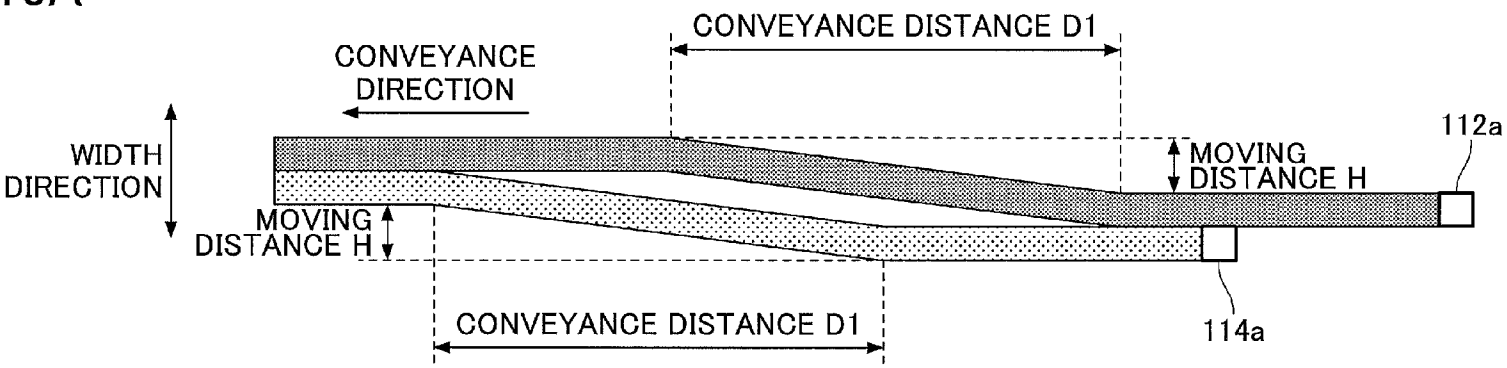
FIG. 10A is a diagram illustrating an example liquid ejection area.
Figure 10B:
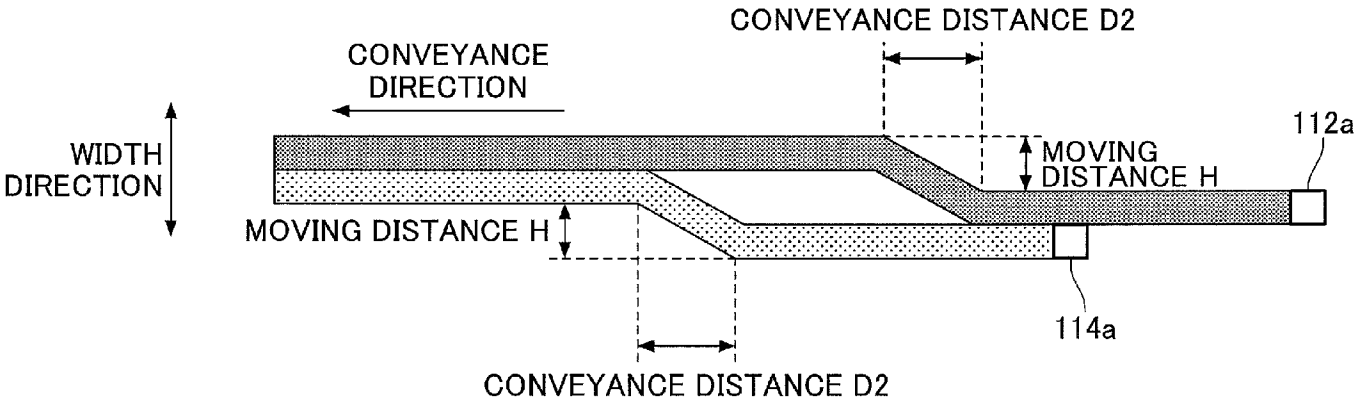
FIG. 10B is a diagram illustrating another example liquid ejection area.

FIG. 10A and FIG. 10B are diagrams illustrating an example liquid ejection operation on the print sheet. In FIG. 10A and FIG. 10B, a liquid ejection area in which the ink droplets ejected from the nozzle 112*a* of the first liquid ejection head 111 are adhered is illustrated with a hatching pattern that is different from a hatching pattern for illustrating a liquid ejection area in which the ink droplets ejected from the nozzle 114*a* of the second liquid ejection head 113 are adhered.

In FIG. 10A, example areas are depicted, in which the nozzles 112*a* and 114*a* form images on the print sheet P in a case where the print sheet P is conveyed at the high conveyance speed. As illustrated in FIG. 10A, the print sheet P is conveyed at the high conveyance speed by a distance D1 while the liquid ejection unit 101 moves a distance H in the width direction.

Here, the nozzles 112*a* and 114*a* are spaced each other in the conveyance direction. Therefore, as illustrated in FIG. 10A, in a case where the liquid ejection unit 101 moves in the width direction, the liquid ejection area of the nozzle 112*a* is slightly spaced from the liquid ejection area of the nozzle 114*a*.

Also, in FIG. 10B, example areas are depicted, in which the nozzles 112*a* and 114*a* form images on the print sheet P in a case where the print sheet P is conveyed at the low conveyance speed. As illustrated in FIG. 10B, the print sheet P is conveyed at the low conveyance speed by a distance D2 (less than D1) while the liquid ejection unit 101 moves a distance H in the width direction.

In a case where the print sheet P is conveyed at the low conveyance speed, the conveyance distance of the print sheet P during the move of the liquid ejection unit 101 in the width direction becomes shorter in comparison to a case of the high conveyance speed. Therefore, on the print sheet P, the liquid ejection areas of the nozzles 112*a* and 114*a* are more rapidly changed in the width direction in comparison to a case of the high conveyance speed. Therefore, the space between the liquid ejection areas of the nozzle 112*a* and the nozzle 114*a*, which is formed in a case of the low conveyance speed, is in a shape different from that in a case of the high conveyance speed. Thus, the color unevenness in the image formed on the print sheet P may seem to be increased.

Figure 11:
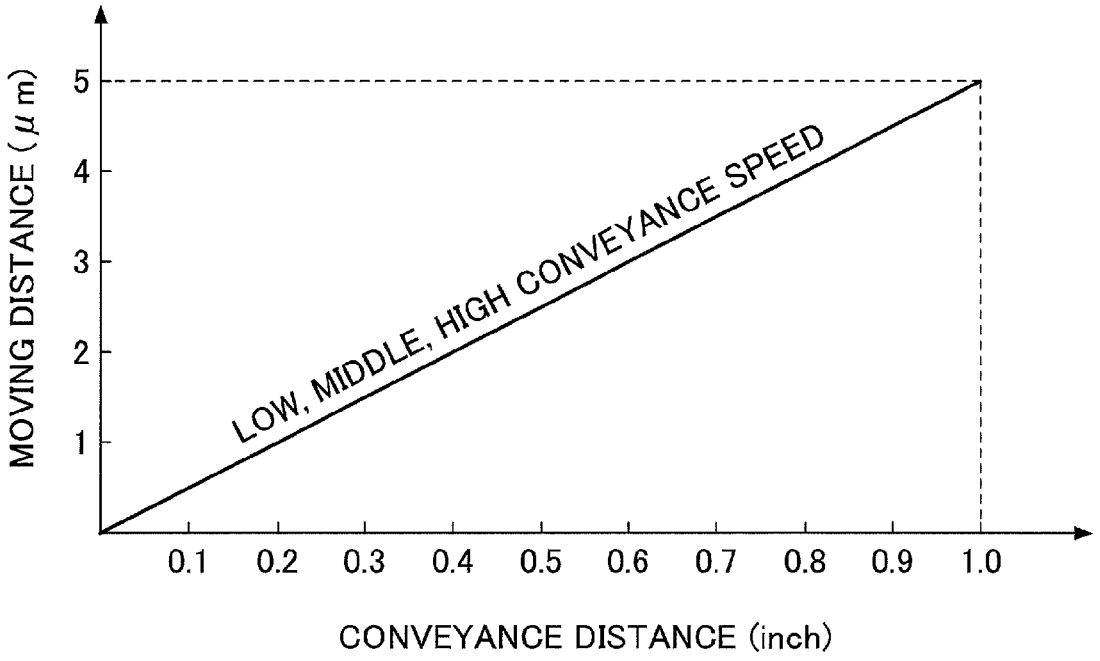
FIG. 11 is a graph illustrating another example of relationship between a print sheet conveyance distance and a moving distance of the liquid ejection unit.

Therefore, in the present embodiment, as illustrated in FIG. 11, the moving speed determination unit 164 calculates a moving speed for moving the liquid ejection unit 101 by a predetermined moving distance (e.g., 5 μm) while the print sheet P is conveyed by a predetermined distance (e.g., 1 inch).

As illustrated in FIG. 11, by determining the moving speed by the moving speed determination unit 164 as describe above, the relationship between a print sheet conveyance distance and a moving distance of the liquid ejection unit 101 becomes constant regardless of the conveyance speed of the print sheet P.

In FIG. 11, an example relationship between the print sheet conveyance distance and the moving distance of the liquid ejection unit 101 is illustrated, in which the print sheet P is conveyed by 1 inch while the liquid ejection unit 101 moves 5 μm in the width direction, where the conveyance speed may be any of high, middle, and low.

In the present embodiment, the move control unit 165 performs a position correction control of the liquid ejection unit 101 while the print sheet P is conveyed by a predetermined control distance. Therefore, for example, the moving speed of the liquid ejection unit 101 is set so that the liquid ejection unit 101 can move a maximum distance while the print sheet P is conveyed at the high conveyance speed to perform the position correction. Thus, the position correction can be performed even if the print sheet P is conveyed at the high conveyance speed.

When the moving speed is set in this way, the position correction of the liquid ejection unit 101 can be completed while the print sheet P is conveyed the predetermined control distance regardless of the conveyance speed, provided that a position shift amount of the conveyed print sheet P in the width direction is within a predetermined range. Additionally, for example, the maximum moving distance of the liquid ejection unit 101 is set based on the position shift amount of the conveyed print sheet P in the width direction, and the like.

In the present embodiment, the moving speed of the liquid ejection unit 101 is changed in accordance with the conveyance speed of the print sheet P. Therefore, the liquid ejection areas of the respective nozzles 112*a* and 114*a*, which are similar to the liquid ejection areas illustrated in FIG. 10A, can be formed even when the conveyance speed is middle, or low. In this way, the unevenness of the ink droplet interval on the print sheet P can be suppressed because the space between the liquid ejection areas of nozzles that are adjoining in the width direction becomes similar shape regardless of the conveyance speed of the print sheet P, thereby preventing the ink droplet interval unevenness from seeming to be increased.

Additionally, the position moving amount of the liquid ejection unit 101 in the width direction corresponds to a very short distance. Therefore, the liquid ejection unit 101 may arrive at the position corresponding to the position moving amount before the moving speed of the liquid ejection unit 101 reach the set moving speed. Hence, the moving speed determination unit 164 may calculate an acceleration rate as well as the moving speed so that the liquid ejection unit 101 moves a predetermined distance while the print sheet P is conveyed the predetermined control distance.

In this case, the move control unit 165 sets the moving speed and the acceleration rate calculated by the moving speed determination unit 164 in the controller 155, thereby controlling the liquid ejection unit 101 to move at the moving speed and the acceleration rate calculated by the moving speed determination unit 164.

<Position Correction Control Process>

Figure 12:
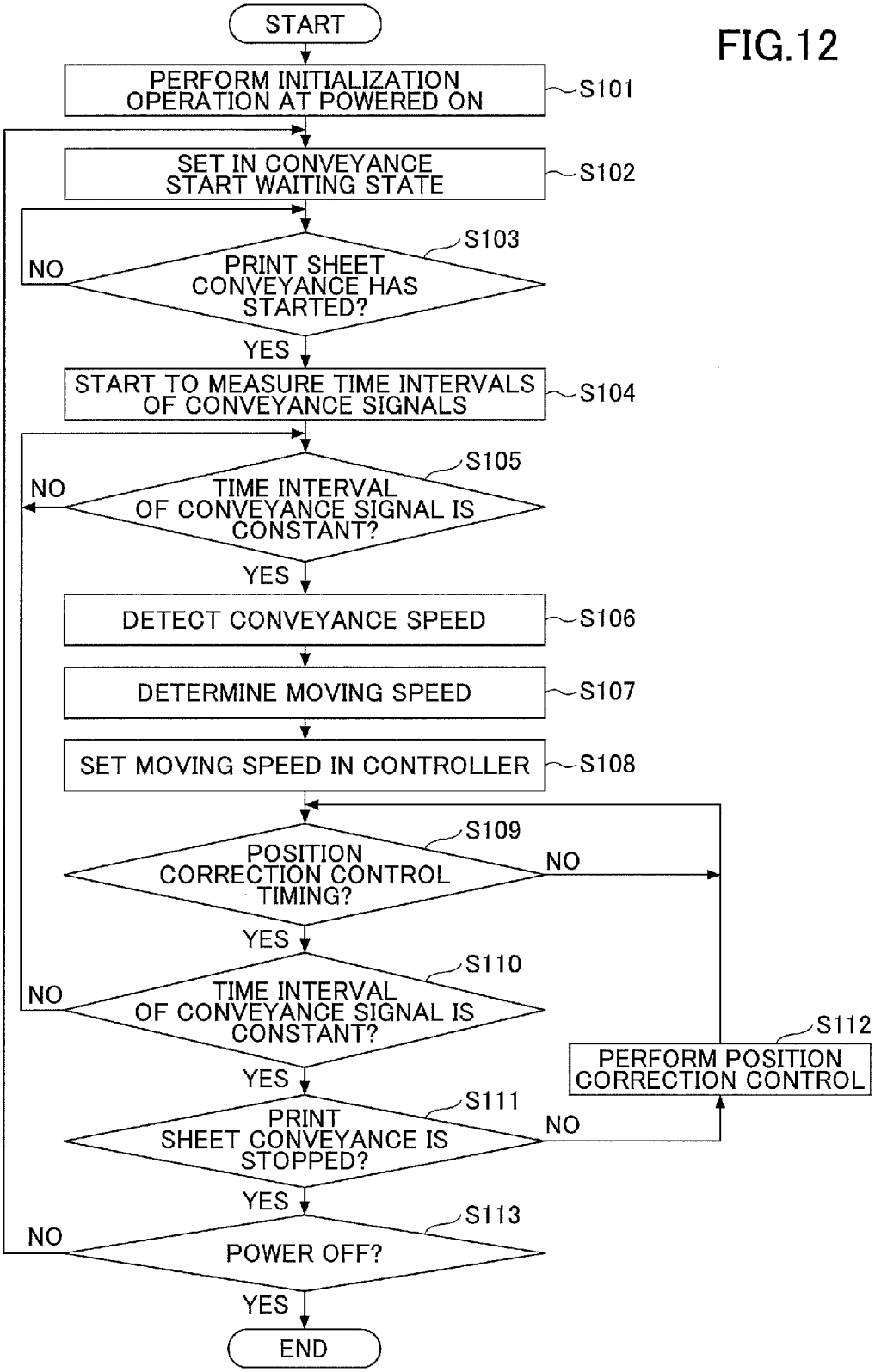
FIG. 12 is a flowchart for illustrating a position correction control process.

FIG. 12 is a flowchart for illustrating a position correction control process of the present embodiment.

In step S101, upon the liquid ejection apparatus 100 being powered on, an initialization operation at powered on is performed. For example, position adjustment of the liquid ejection unit 101 by the actuator 103, operation check of the edge sensor 102, etc., are performed as the initialization operation at powered on. In step S102, in response to completing the initialization operation at powered on being completed, respective units including the conveyance roller 120 of the liquid ejection apparatus 100 are set to be in a conveyance start waiting state.

In response to staring the conveyance of the print sheet P in the liquid ejection apparatus 100 (YES in step S103), the conveyance speed detection unit 163 starts to measure time intervals of conveyance signals output from the encoder 121 provided for the conveyance roller 120 to the speed detection circuit 156.

For example, upon the time intervals of conveyance signals output from the encoder 121 being constant (YES in step S105), the conveyance speed detection unit 163 acquires the conveyance speed of the print sheet P detected by the speed detection circuit 156 in step S106.

In step S107, the moving speed determination unit 164 determines the moving speed of the liquid ejection unit 101 based on the moving speed of the print sheet P detected by the conveyance speed detection unit 163. As described above, the moving speed determination unit 164 determines the moving speed for moving the liquid ejection unit 101 by a predetermined moving distance while the print sheet P is conveyed by the control distance at the detected conveyance speed.

In step S108, the move control unit 165 sets the moving speed determined by the moving speed determination unit 164 in the controller 155. In step S109, the move control unit 165 determines whether to perform the position correction control of the liquid ejection unit 101 now.

In the present embodiment, the position correction control of the liquid ejection unit 101 is performed each time the print sheet P is to be conveyed by the predetermined distance (e.g., 1 inch). The move control unit 165 determines whether the print sheet P is conveyed by a predetermined conveyance distance from conveyance start or previous timing for performing the position correction control based on the conveyance signal transmitted from the encoder 121 provided for the conveyance roller 120 to the speed detection circuit 156. In a case where position correction control is to be performed now (YES in step S109), the process is proceeded to step S110.

In step S110, the conveyance speed detection unit 163 determines whether the measured time intervals of the conveyance signals are constant. In a case where the time intervals of the conveyance signals are not constant (NO in step S110), processes of step S105 and subsequent steps are performed. In a case where the time intervals of the conveyance signals are constant, the move control unit 165 determines whether the conveyance of the print sheet P is stopped in step S111.

In a case where the print sheet P is conveyed (NO in step S111), the position correction control of the liquid ejection unit 101 is performed in step S112. Specifically, the liquid ejection unit 101 is moved in the width direction by the position moving amount at the moving speed calculated by the moving speed determination unit 164, where the position moving amount is calculated by the move amount determination unit 162 based on the edge position of the print sheet P.

The position correction control is performed in a case where the print sheet P is conveyed at a constant conveyance speed (YES in step S110). In a case where the conveyance speed of the print sheet P is changed (NO in step S110), the moving speed is recalculated after the conveyance speed of the print sheet P becomes constant again, thereby performing the position correction control of the liquid ejection unit 101 based on the recalculated moving speed.

The position correction control of the liquid ejection unit 101 is repeatedly performed at every position correction control timing while the print sheet P is conveyed at the set conveyance speed (without changing conveyance speed). Thus, the liquid ejection position of the liquid ejection unit 101 is corrected, and color shift can be suppressed.

In a case where the conveyance of the print sheet P is stopped (YES in step S111), the process is proceeded to step S113. In a case where the conveyance of the print sheet P is stopped and the liquid ejection apparatus 100 is not powered off (NO in step S113), processes of step S102 and subsequent steps are performed. In a case where the conveyance of the print sheet P is stopped and the liquid ejection apparatus 100 is powered off (YES in step S113), the position correction control process is terminated.

As described above, according to the liquid ejection apparatus 100 of the present embodiment, the moving speed of the liquid ejection unit 101 in the width direction is controlled to be changed in accordance with the conveyance speed of the print sheet P. In the present embodiment, as described above, the moving speed of the liquid ejection unit 101 in the width direction is controlled so that the moving distance of the liquid ejection unit 101 with respect to the conveyance distance of the print sheet P becomes constant at any conveyance speeds of the print sheet P. By controlling the moving speed of the liquid ejection unit 101 in such a manner, the dot interval unevenness on the print sheet P can be suppressed because the space between the liquid ejection areas of nozzles respectively forming dots at positions that are adjoining in the width direction becomes similar shape, where the space is formed when the liquid ejection unit 101 is moved.

Additionally, in the embodiments described above, the image is formed on a long print sheet P. However, for example, the image may be formed on separate short print sheets. Also, the liquid ejection apparatus is not limited to be used for forming visible and meaning image such as a character and a figure by ejecting the liquid. For example, the liquid ejection apparatus may form a meaningless pattern or a three-dimensional image.

Also, in the above-described embodiment, the edge position of the print sheet P in the width direction is detected by the edge sensor 102. However, the position of the print sheet P in the width direction may be detected by a sensor 200 described below.

Figure 13:
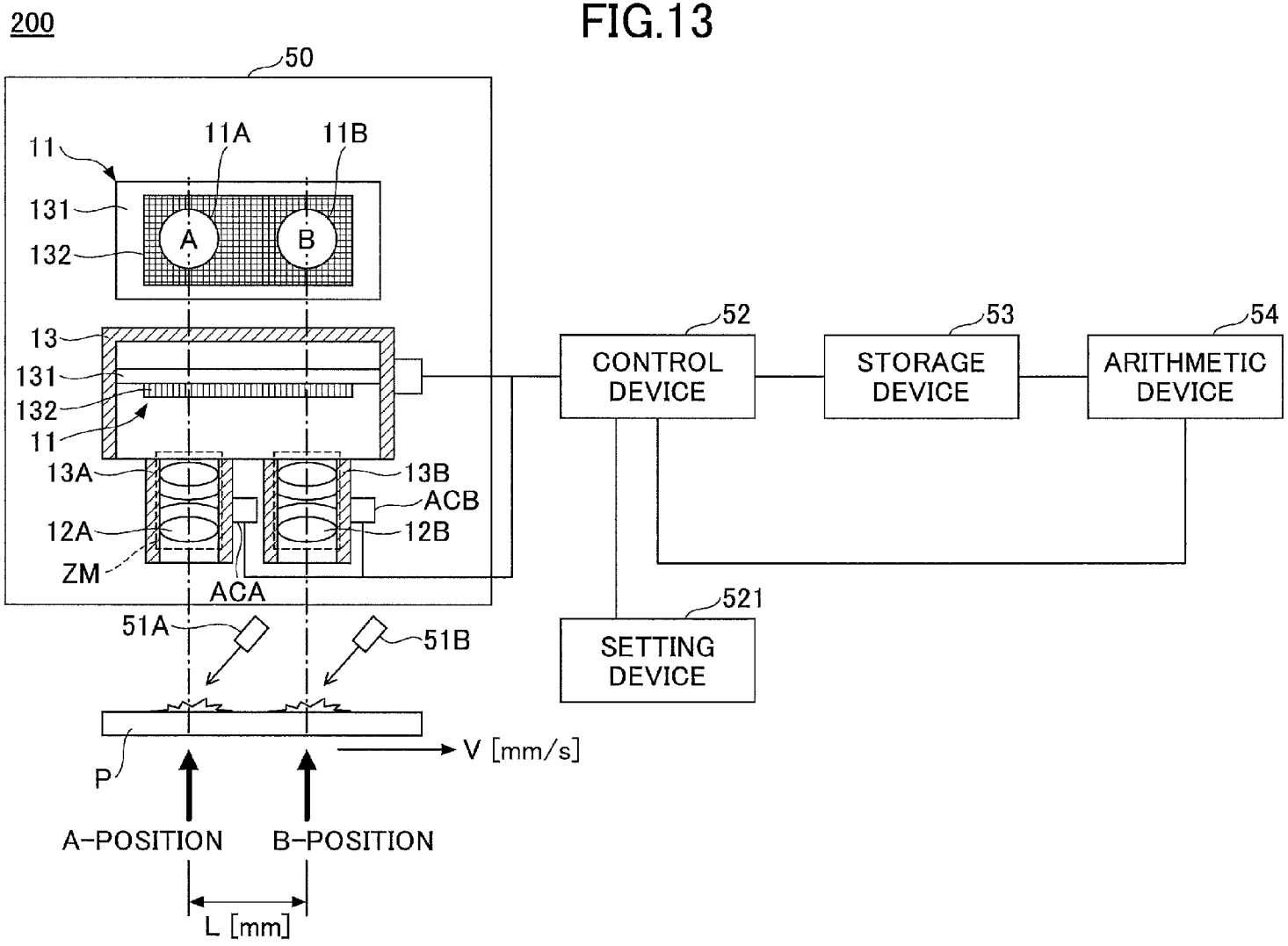
FIG. 13 is a diagram illustrating an example hardware configuration of a sensor.

FIG. 13 is a diagram illustrating an example hardware configuration of the sensor 200 of an embodiment of the present disclosure.

As illustrated in FIG. 13, the sensor 200 includes a detection device 50, a first light source 51A, a second light source 51B, a control device 52, a storage device 53, and an arithmetic device 54.

The first light source 51A and the second light source 51B respectively include a light emitting element for emitting laser beam and a collimator lens for collimating the laser beam emitted from the light emitting element, where the laser beam is incident on the print sheet P. For example, the light emitting elements included in the first light source 51A and the second light source 51B are LDs, LEDs, and the like.

The first light source first light source 51A and the second light source 51B are disposed at positions so that the emitted laser beam inclines with respect to the surface of the print sheet P. A position on the print sheet P, on which the laser beam emitted from the first light source 51A is incident, is referred to "A-position". A position on the print sheet P, on which the laser beam emitted from the second light source 51B is incident, is referred to "B-position".

The detection device 50 includes an area sensor 11, a first capturing lens 12A that is disposed at a position facing the A-position, and a second capturing lens 12B that is disposed at a position facing the B-position.

The area sensor 11 includes a capturing element 132 provided on a silicon substrate 131, where the area sensor 11 is included in a housing 13. The capturing element 132 includes an A-area 11A and B-area 11B, at which two dimensional images are respectively captured. Also, for example, the area sensor 11 is a CCD sensor, a CMOS sensor, a photodiode array.

The first capturing lens 12A is supported by a first lens barrel 13A, where a light axis of the first capturing lens 12A corresponds to a center of the A-area 11A of the capturing element 132. The first capturing lens 12A images the light on the A-area 11A of the capturing element 132. Also, the second capturing lens 12B is supported by a second lens barrel 13B, where a light axis of the second capturing lens 12B corresponds to a center of the B-area 11B of the capturing element 132. The second capturing lens 12B images the light on the B-area 11B of the capturing element 132. The first capturing lens 12A and the second capturing lens 12B form zoom lenses for adjusting optical zoo magnification rate by changing positions of respective lenses ZM.

A zoom mechanism including an actuator ACA is included in the first capturing lens 12A. Also, a zoom mechanism including an actuator ACB is included in the second capturing lens 12B. For example, when an optical zoom magnification rate is changed, the respective zoom mechanisms change the positions of the first capturing lens 12A and second capturing lens 12B so as to achieve a set optical magnification rate.

Also, a shutter for controlling diaphragm and shutter speed may be provided for the first capturing lens 12A and second capturing lens 12B.

Additionally, the first capturing lens 12A and the second capturing lens 12B may be integrated in the detection device 50. In this case, preferably, an aperture for limiting imaging area is provided between the area sensor 11 and the first capturing lens 12A and the second capturing lens 12B so that interference of images formed by the first capturing lens 12A and the second capturing lens 12B can be prevented.

Also, in the detection device 50, a plurality of the capturing elements 132 may be provided on the silicon substrate 131 of the area sensor 11. In this case, the capturing elements 132 are respectively disposed at positions where the light from the first capturing lens 12A images and the light from the second capturing lens 12B images.

The control device 52 of the sensor 200 controls the detection device 50, and the like. For example, the control device 52 controls a shutter timing of the area sensor 11 by transmitting a signal to the detection device 50. Also, the control device 52 acquires the two dimensional image from the detection device 50 and transmits the acquired two dimensional image to the storage device 53.

For example, the storage device 53 is a memory, and stores the two dimensional image transmitted from the control device 52. For example, the storage device 53 divides the two dimensional image so as to store the divided images in discrete storage areas.

For example, the arithmetic device 54 is a microcomputer, and performs processes using data of the image stored in the storage device 53.

For example, the control device 52 and the arithmetic device 54 respectively include a CPU and an electronic circuit. Also, the control device 52 and the arithmetic device 54 may include the same CPU.

Figure 14:
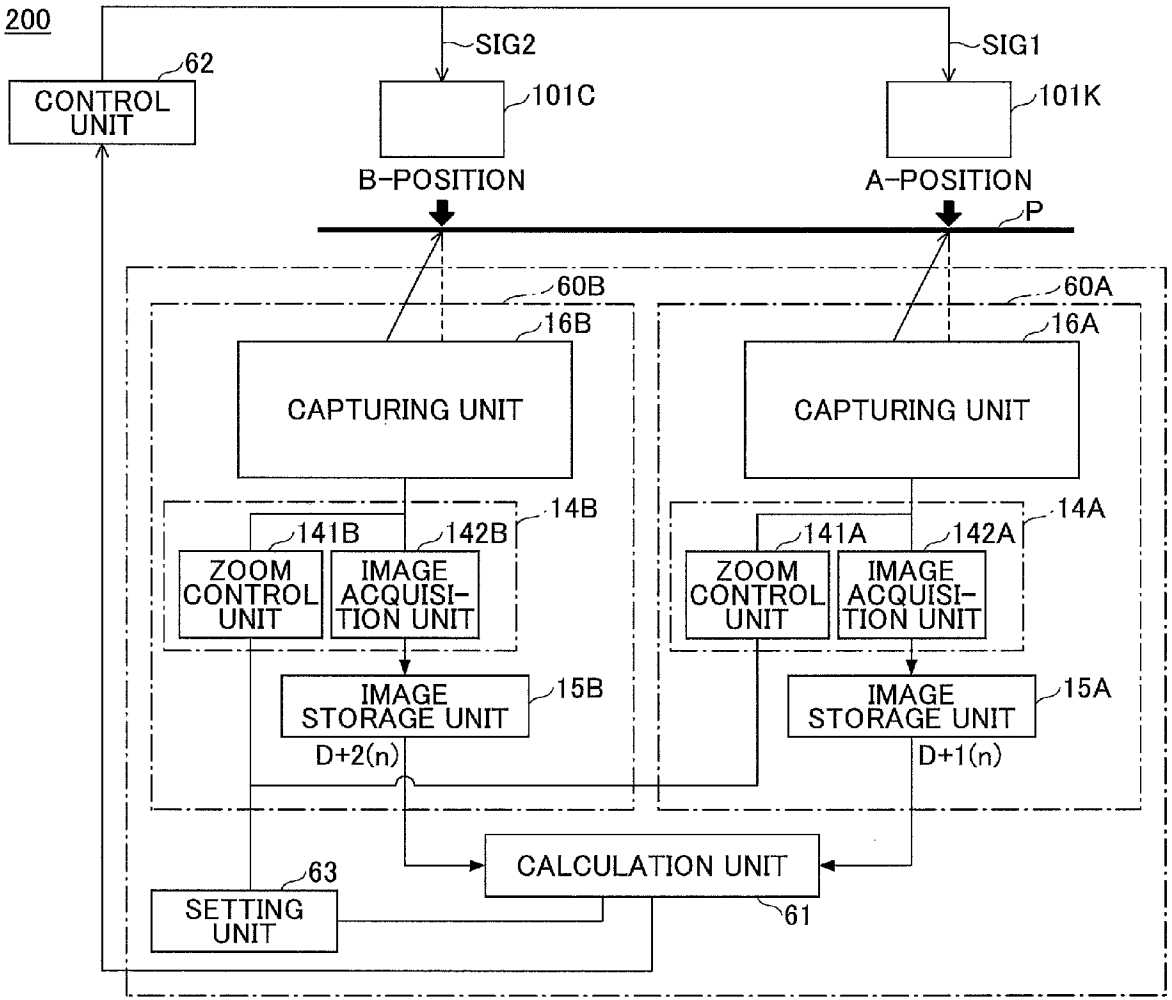
FIG. 14 is a block diagram illustrating an example functional configuration of the sensor.

FIG. 14 is a block diagram illustrating an example functional configuration of the sensor 200 of the present embodiment. In the following, the sensor 200 of the liquid ejection unit 101K (may be referred to as black liquid ejection unit) and the liquid ejection unit 101C (may be referred to as cyan liquid ejection unit) among the sensors 200 will be described, where the sensor 200 is provided on a liquid ejection unit 101-by-liquid ejection unit 101 basis.

In the configuration illustrated in FIG. 14, a detection unit 60A provided for the black liquid ejection unit 101K outputs a detection result of the A-position while a detection unit 60B provided for the cyan liquid ejection unit 101C outputs a detection result of the B-position.

The detection unit 60A of the black liquid ejection unit 101K includes a capturing control unit 14A, an image storage unit 15A, and a capturing unit 16A. Also, the detection unit 60B of the cyan liquid ejection unit 101C includes a capturing control unit 14B, an image storage unit 15B, and a capturing unit 16B. Functions of the detection unit 60A and the detection unit 60B are similar to each other, therefore, in the following, functions of respective units of the detection unit 60A will be described.

The capturing unit 16A captures an image of the conveyed print sheet P. For example, the capturing unit 16A is achieved by the detection device 50.

The capturing control unit 14A includes a zoom control unit 141A and an image acquisition unit 142A. Additionally, for example, the capturing control unit 14A is achieved by the control device 52, and the like. The zoom control unit 141A controls the optical zoom magnification rate of the capturing unit 16A. The image acquisition unit 142A acquires the image captured by the capturing unit 16A.

The image storage unit 15A stores the image acquired by the capturing control unit 14A. For example, the image storage unit 15A is achieved by the storage device 53, and the like.

A calculation unit 61 calculates a position of a pattern of the print sheet P, a conveyance speed of the print sheet P, and a conveyance amount of the print sheet P based on images respectively stored in the image storage units 15A and 15B. Also, the calculation unit 61 may calculates an exposure time and an optical zoom magnification rate of the capturing units 16A and 16B based on the calculated conveyance speed.

Also, for example, the calculation unit 61 outputs data of time difference $\Delta t$ indicating shutter timing to the capturing control units 14A and 14B. That is, the calculation unit 61 transmits the shutter timing to the capturing control units 14A and 14B so that an image of the A-position and an image of the B-position are captured with the time difference $\Delta t$. Also, the calculation unit 61 may control a motor for conveying the print sheet P, etc., so as to convey the print sheet P at the calculated conveyance speed. For example, the calculation unit 61 is achieved by the arithmetic device 54, and the like.

The print sheet P has light scattering property on the surface or in an inside portion of the print sheet P. Therefore, when the laser beam is emitted toward the printing sheet P, the laser beam is diffusedly reflected on the surface or in the inside portion of the print sheep P. When the diffusedly reflected light is interfered, punctate pattern that is referred to as speckle pattern is formed on the print sheet P. Therefore, when the print sheet P, on which the laser beam is incident, is captured, the speckle pattern is included in the captured image. The position of the print sheet P can be defined based on a detected position of the speckle pattern in the captured image.

The position of the speckle pattern in the captured images captured by the capturing units 16A and 16B changes in accordance with the conveyance of the print sheet P. Therefore, the calculation unit 61 can calculate the conveyance amount of the print sheet P based on the change of the position of the speckle pattern in the captured image, where the image is sequentially captured at a predetermined time interval. Also, the calculation unit 61 can find the conveyance speed of the print sheet P by calculating the conveyance amount corresponding to a unit time.

Specifically, in a case where a distance between the first capturing lens 12A and the second capturing lens 12B is indicated by a relative distance L mm, a relationship between the relative distance L mm and the conveyance speed V mm/s can be expressed by formula (1).

$$\Delta t = L/V \tag{1}$$

In the formula (1), the relative distance L mm is a distance between the first capturing lens 12A and the second capturing lens 12B, which has been set in advance. Therefore, when the time difference Δt is defined, a calculation unit 53F can calculate the conveyance speed V mm/s based on the formula (1). Thus, the conveyance speed of the print sheet P can be calculated based on the speckle pattern in the captured image.

Also, the calculation unit 61 can calculate a shift amount in the width direction of the print sheet P from an initial position by adding up the position shift of the speckle pattern included in the captured image in the width direction. Also, the calculation unit 61 can find a current position of the print sheet P in the width direction based on the sift amount.

Further, the calculation unit 61 performs cross correlation calculation with respect to image data Dt1 (*n*) and Dt2 (*n*) that are data of the images captured by the detection units 60A and 60B. In the following, the image generated through the cross correlation calculation is referred to as "correlation image". For example, the calculation unit 61 calculates a shift amount ΔD (n) based on the correlation image.

For example, the cross correlation calculation can be expressed by formula (2)

$$Dt1\#Dt2^* = F^{-1}[F[Dt1]\cdot F[Dt2]^*] \tag{2}$$

Additionally, in formula (2), "Dt1" indicates image data Dt1 (*n*) that is the data of the image captured at A-position. Also, "Dt2" indicates image data Dt2 (*n*) that is the data of the image captured at B-position. Further, "F[ ]" indicates Fourier transform, and "F−1[ ]" indicates inverse Fourier transform. Also, "*" indicates complex conjugate, and "#" indicates cross correlation calculation.

As expressed by formula (2), when the cross correlation calculation "Dt1#Dt2" is performed with respect to the image data Dt1 and the image data Dt2, the image data of the correlation image can be obtained. Additionally, in a case where the image data Dt1 and Dt2 are two dimensional image data, the image data of the correlation image becomes two dimensional image data. Also, in a case where the image data Dt1 and Dt2 are single dimensional image data, the image data of the correlation image becomes single dimensional image data.

Additionally, for example, phase restricting correlation method may be used in a case where broad brightness distribution is concerned. For example, the phase restricting correlation method uses a calculation expressed by formula (3).

$$Dt1\#Dt2^* = F^{-1}[P[F[Dt1]]\cdot P[F[Dt2]^*]] \tag{3}$$

In formula (3), "P[ ]" indicates that only phase is extracted in complex amplitude. Also, the amplitude is always "1". By using formula (3), the calculation unit 61 can calculate the shift amount ΔD (n) based on the correlation image even when the brightness distribution is broad.

The correlation image indicates correlation between the image data Dt1 and the image data Dt2. Specifically, a steep peak (so called correlation peak) of the brightness is found at a position close to a center of the correlation image as a degree of coincidence between the image data Dt1 and the image data Dt2 becomes greater. When the image data Dt1 is coincident with the image data Dt2, the peak is formed at the center of the correlation image.

The black liquid ejection unit 101K and the cyan liquid ejection unit 101C respectively eject liquid based on the timing calculated as described above. Additionally, the timing for ejecting the liquid is controlled by a first signal SIG1 for the black liquid ejection unit 101K and a second signal SIG2 for the cyan liquid ejection unit 101C respectively output from a control unit 62. As illustrated in FIG. 14, the control unit 62 outputs the signal to control the timing based on a calculation result of the calculation unit 61. Additionally, for example, the control unit 62 is achieved by the control device 52, and the like.

Also, the calculation unit 61 may output the calculated conveyance speed V to a setting unit 63. For example, the setting unit 63 calculates the optical zoom magnification rate, the diaphragm, the exposure time based on the conveyance speed V received from the calculation unit 61. Also, the conveyance speed V may be input in the setting unit 63 according to an operation mode that defines resolution of the output image, and the like. Additionally, for example, the setting unit 63 is achieved by a setting device 521 such as a microcomputer.

For example, the setting unit 63 sets the optical zoom magnification rate to be smaller in a case where the conveyance speed V is high. The zoom control units 141A and 141B cause the actuators ACA and ACB to operate and controls the zoom lens ZM so as to achieve the optical zoom magnification rate set by the setting unit 63. Additionally, the setting unit 63 may set the diaphragm or the shutter speed.

For example, the setting unit 63 calculates the diaphragm through formula (4) so that light receiving amount is inversely proportional to the exposure time defined in accordance with the conveyance speed V.

$$I = Io \times (NA \times Mo)^2$$

$$\text{Focal Depth} = \pm k \times \text{Wave Length}/(2\times(\text{Numerical Aperture})^2) \tag{4}$$

In formula (4), "I" indicates brightness of the image and "Io" indicates brightness of surface of a test piece. "NA" indicates Numerical Aperture that is an example diaphragm. Also, "Mo" indicates magnification rate of an object lens. In formula (4), the light receiving amount is proportional to (Numerical Aperture)$^2$, therefore, if the exposure time is reduced by being divided by "2", the Numerical Aperture needs to be multiplied by square root of "2". Additionally, the optical zoom magnification rate, the exposure time, and a diaphragm corresponding to the conveyance speed may be set in advance based on an experiment or evaluation.

Also, for example, the optical zoom magnification rate can be calculated as follows. First, a shutter speed is set according to the conveyance speed V. Specifically, in a case where the conveyance speed V is high, the shutter speed is often set to be high because the conveyed object moves at high speed. Therefore, the shutter speed is set so as to be proportional to the conveyance speed V.

When the shutter speed set to be high, the light receiving amount becomes smaller. That is, when the shutter speed is set in accordance with the conveyance speed V, the light receiving amount is inverse proportional to the conveyance speed V. Therefore, in a case where the conveyance speed V is set to be high, the optical zoom magnification rate is set to be smaller. When the optical zoom magnification rate becomes smaller, shift amount with respect to one pixel can be reduced.

For example, the optical zoom magnification rate can be calculated as follows. In the following, as a specific example, a case where the conveyance speed V is changed from "1 m/s" to "3 m/s", that is, the conveyance speed V is multiplied by "3". Also, the captured area is under uniform illumination condition, and the lens has the same numerical aperture.

First, the shutter speed is set to be three times higher in accordance with the conveyance speed V that has been multiplied by three. When the shutter speed is multiplied by three, the light receiving amount is reduced (becomes dark) because the light receiving amount is divided by three. On the other hand, the light receiving amount can be defined depending on a light receiving area when the numerical aperture is the same value. Also, the light receiving amount is inverse proportional to the square of the optical zoom magnification rate. Therefore, the optical zoom magnification rate is calculated based on formula (5) so as to increase the light receiving amount by multiplying the light receiving amount by three.

Shutter speed×3:

Light receiving amount 1/3

$$\text{Light receiving amount; triplication}=1/(1/\sqrt{3})2=3:$$

$$\text{Optical zoom magnification rate; } 1/\sqrt{3}\cong 0.57 \quad (5)$$

In this way, the light receiving amount can be maintained or increased when the optical zoom magnification rate is reduced in accordance with the conveyance speed V. Also, when the optical magnification rate is reduced, a relative shift amount can be reduced.

Figure 15:
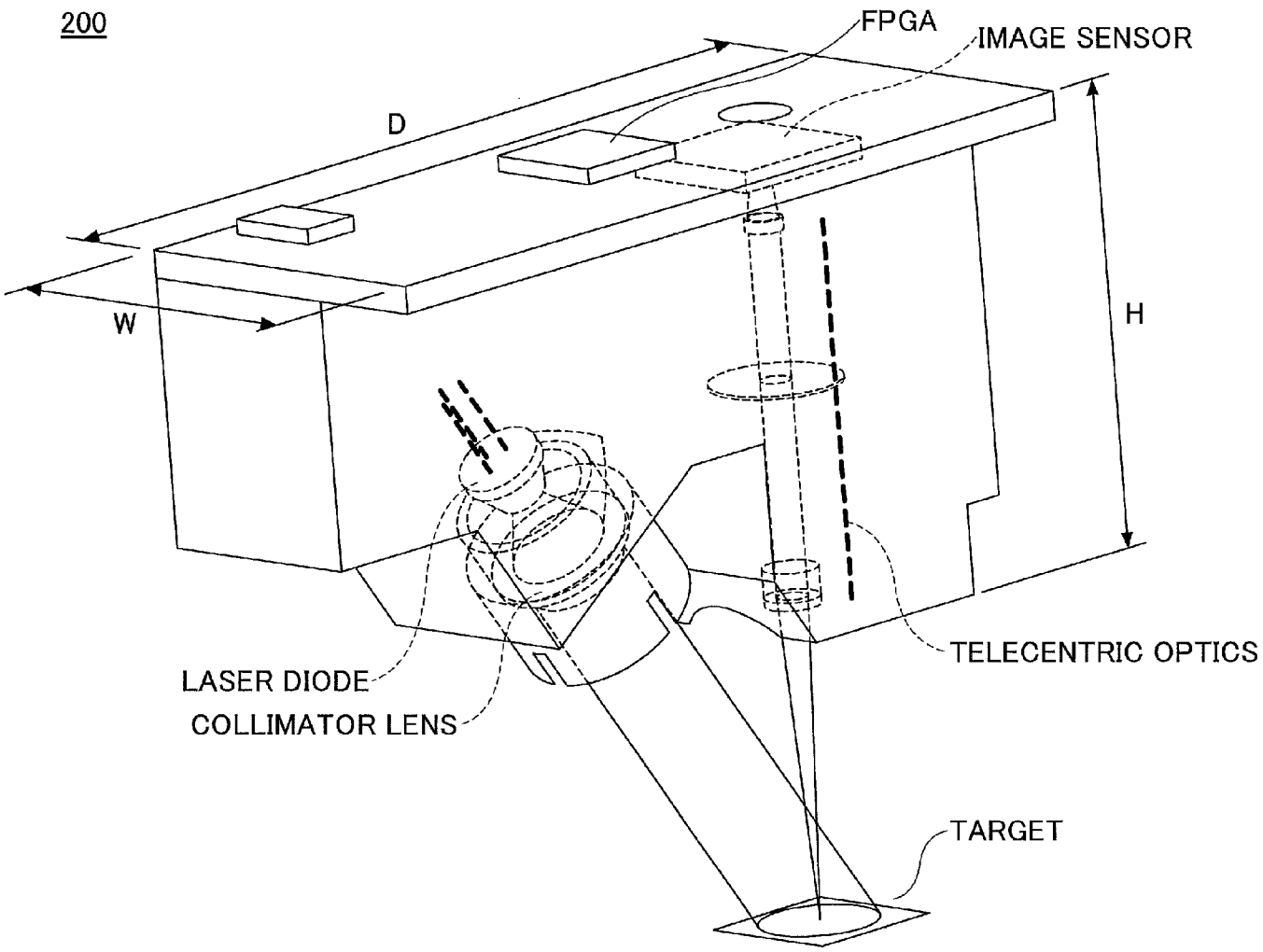
FIG. 15 is an external view of an example sensor.

FIG. 15 is an external view of an example sensor 200 of the present embodiment. The sensor 200 includes a semiconductor laser light source (LD) and a collimating optical system (CL) for emitting the laser beam toward an object such as the print sheet P, thereby forming the speckle pattern. Also, the sensor 200 includes a CMOS image sensor for capturing the speckle pattern, and a telecentric capturing optical system (OL) for imaging the light of the speckle pattern on the CMOS image sensor. Additionally, the sensor 200 may include a light emitting diode (LED) as a light source.

For example, the CMOS image sensor captures the image including the speckle pattern at a predetermined time interval. Also, in a FPGA circuit, the cross correlation calculation between the image captured at time T1 and the image captured at time T2 is performed, and position moving amount of the object from the time T1 to the time T2 is calculated, based on movement of the correlation peak, to be output.

For example, the sensor 200 illustrated in FIG. 15 has a width W of 15 mm, a depth D of 60 mm, and a height H of 32 mm. Additionally, the CMOS image sensor is an example capturing unit, and the FPGA circuit is an example arithmetic device.

Preferably, the sensor 200 is disposed adjacent to the ejection position of the liquid ejection unit 101. By detecting the position of the print sheet P at a position adjoining to the ejection position, the position of the liquid ejection unit 101 in the width direction can be precisely controlled in accordance with the position of the print sheet P.

Figure 16:
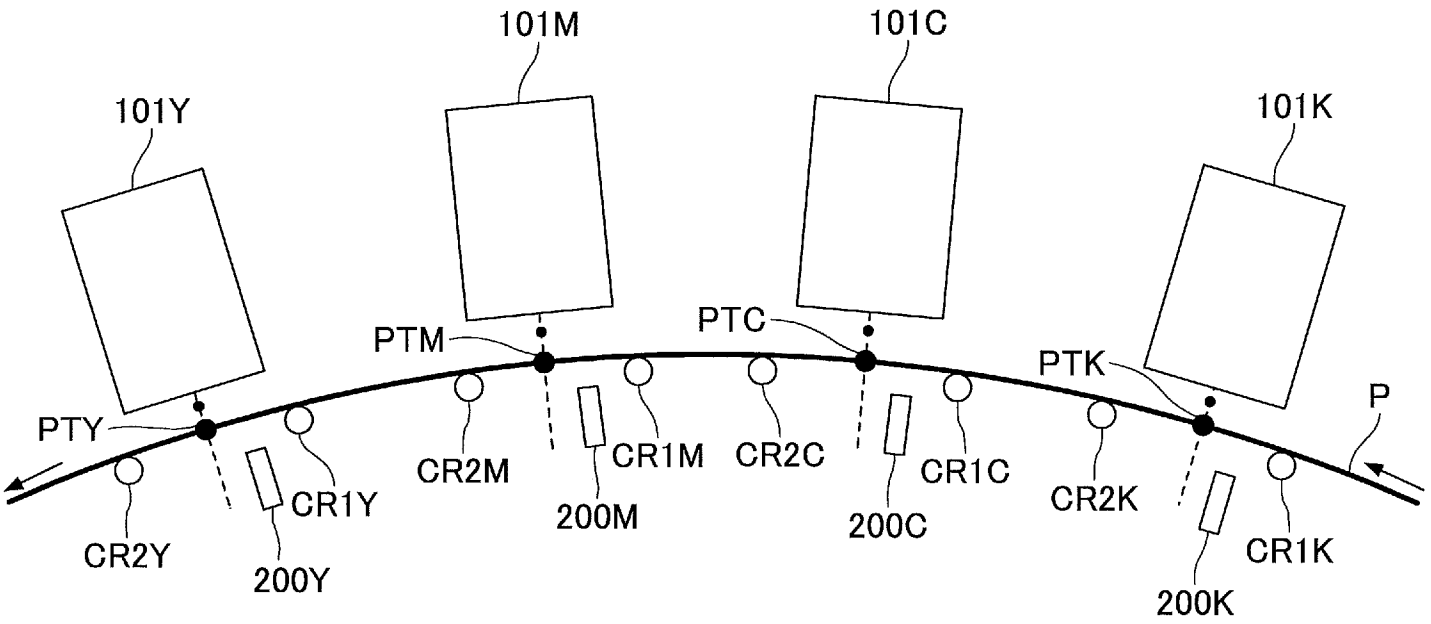
FIG. 16 is a side view of the liquid ejection units and the sensors.

FIG. 16 is a diagram illustrating an arrangement of the sensor 200. FIG. 16 is a side view of the liquid ejection units 101 and the sensors 200.

As illustrated in FIG. 16, a first roller CR1 and a second roller CR2 are disposed at an upstream side and downstream side of a liquid ejection point PT of the liquid ejection unit 101, where the first roller CR1 and the second roller CR2 support the print sheet P from the back surface (a surface opposite to the surface on which the liquid is ejected from the liquid ejection unit 101). The first roller CR1 and the second roller CR2 are rotatably mounted, and rotated following movement of the conveyed print sheet P. Additionally, for example, a supporting member that contacts with the print sheet P sliding on the supporting member may be used as long as the supporting member can support the print sheet P in the upstream side and the downstream side of the liquid ejection point PT of the liquid ejection unit 101. Thus, driven rollers following movement of the conveyed print sheet P, such as the first roller CR1 and the second roller CR2, are not necessary required.

In the example configuration illustrated in FIG. 16, the sensors 200 and the liquid ejection units 101 are disposed with placing the print sheet P therebetween, and a position between the first roller CR1 and the liquid ejection position PT is detection position.

The sensor 200 is preferably disposed so that the detection position is positioned between the first roller CR1 and the second roller CR2. The conveyance position of the print sheet P becomes stable between the first roller CR1 and the second roller CR2, and a distance between the sensor 200 and the print sheet P is kept at a constant distance. Therefore, the position of the print sheet P can be precisely detected.

Also, the sensor 200 is preferably disposed so that the detection position is positioned in the upstream side of the ejection position PT of the liquid ejection unit 101, and adjacent to the ejection point PT. When the sensor 200 is disposed so that the detection position is positioned in the upstream side of the ejection position PT, the ejection position PT of the liquid ejection unit 101 can be precisely adjusted in accordance with the position of the print sheet P. Also, by reducing the distance between the detection position of the sensor 200 and the ejection position PT, an affection of a shift of conveyance position of the print sheet P between the detection point and the ejection point PT can be suppressed to the minimum, thereby adjusting the position of the liquid ejection unit 101 in accordance with the position of the print sheet P.

Herein above, although the present disclosure has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth. The present application claims priority under 35 U.S.C. §119 to Japanese Patent Application No. 2015-206329 filed on Oct. 20, 2015, and Japanese Patent Application No. 2016-166522 filed on Aug. 29, 2016. The contents of which are incorporated herein by reference in their entirety.

What is claimed is:

1. A position correction apparatus that corrects a position of a liquid ejection unit ejecting liquid toward a conveyed object, the position correction apparatus comprising:

a position detection unit configured to detect a position of the conveyed object in a width direction of the conveyed object;

a moving unit configured to move the liquid ejection unit in the width direction;

a moving amount determination unit configured to determine a moving amount of the liquid ejection unit in the width direction based on a position of the conveyed object in the width direction;

a moving speed determination unit configured to determine a moving speed of the liquid ejection unit in accordance with a conveyance speed of the conveyed object; and a move control unit configured to control the moving unit so as to move the liquid ejection unit at the moving speed and by the moving amount in the width direction.

2. The position correction apparatus according to claim 1, wherein the move control unit controls the moving unit so as to move the liquid ejection unit while the conveyed object is conveyed a predetermined control distance, the control being performed each time the conveyed object is to be conveyed the predetermined control distance, and wherein the moving speed determination unit determines the moving speed so as to move the liquid ejection unit a predetermined moving distance while the conveyed object is conveyed the predetermined control distance.

3. The position correction apparatus according to claim 2, wherein the moving speed determination unit determines the moving speed upon the conveyance speed of the conveyed object being constant.

4. The position correction apparatus according to claim 1, further comprising a conveyance speed detection unit configured to detect the conveyance speed of the conveyed object based on a conveyance signal output from a conveyance unit that conveys the conveyed object, the conveyance signal being output each time the conveyed object is to be conveyed the predetermined detection distance, wherein the conveyance speed determination unit determines the moving speed of the conveyed object based on the conveyance speed detected by the conveyance speed detection unit.

5. The position correction apparatus according to claim 1, wherein the position detection unit detects an edge position of the conveyed object in the width direction.

6. The position correction apparatus according to claim 1, wherein the position detection unit detects a position of the conveyed object in the width direction by detecting a pattern resulting from property of the conveyed object.

7. The position correction apparatus according to claim 6, wherein the position detection unit detects the pattern from a two dimensional captured image of the conveyed object.

8. A liquid ejection apparatus comprising the position correction apparatus according to claim 1.

9. A method for correcting a position of a liquid ejection unit ejecting liquid toward a conveyed object, the method comprising:

detecting a position of the conveyed object in a width direction of the conveyed object;

determining a moving amount of the liquid ejection unit in the width direction based on a position of the conveyed object in the width direction;

determining a moving speed of the liquid ejection unit in accordance with a conveyance speed of the conveyed object; and moving the liquid ejection unit at the moving speed and by the moving amount in the width direction.

* * * * *